US008730148B2

(12) United States Patent
Park et al.

(10) Patent No.: US 8,730,148 B2
(45) Date of Patent: May 20, 2014

(54) METHOD OF DRIVING A LIGHT SOURCE, LIGHT SOURCE APPARATUS FOR PERFORMING THE METHOD AND DISPLAY APPARATUS HAVING THE LIGHT SOURCE APPARATUS

(75) Inventors: Young-Min Park, Seoul (KR); Gi-Cherl Kim, Yongin-si (KR); Se-Ki Park, Suwon-si (KR); Si-Joon Song, Suwon-si (KR); Young-Keun Lee, Cheonan-si (KR); Yong-Hoon Kwon, Asan-si (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 691 days.

(21) Appl. No.: 12/465,802

(22) Filed: May 14, 2009

(65) Prior Publication Data

US 2010/0123401 A1 May 20, 2010

(30) Foreign Application Priority Data

Nov. 19, 2008 (KR) ..... 10-2008-0115407

(51) Int. Cl.
*G09G 3/36* (2006.01)

(52) U.S. Cl.
USPC ..... 345/102

(58) Field of Classification Search
USPC ..... 345/102
See application file for complete search history.

(56) References Cited

U.S. PATENT DOCUMENTS

| | | | | |
|---|---|---|---|---|
| 7,972,050 | B2 * | 7/2011 | Overes et al. | 362/555 |
| 2007/0070024 | A1 * | 3/2007 | Araki et al. | 345/102 |
| 2007/0268234 | A1 * | 11/2007 | Wakabayashi et al. | 345/102 |
| 2008/0084524 | A1 * | 4/2008 | Inuzuka et al. | 349/108 |
| 2008/0165203 | A1 * | 7/2008 | Pantfoerder | 345/589 |
| 2008/0165810 | A1 * | 7/2008 | Takeda | 372/21 |
| 2008/0218501 | A1 * | 9/2008 | Diamond | 345/207 |
| 2008/0252572 | A1 * | 10/2008 | Kang et al. | 345/77 |
| 2009/0010537 | A1 * | 1/2009 | Horie et al. | 382/167 |

FOREIGN PATENT DOCUMENTS

| | | | | |
|---|---|---|---|---|
| JP | 2005-347133 | | 12/2005 | |
| KR | 1020010010195 | | 2/2001 | |
| KR | 20-0238202 | | 7/2001 | |
| KR | 1020080064324 | | 7/2008 | |
| WO | WO200576602 | A1 * | 8/2005 | H04N 5/64 |

OTHER PUBLICATIONS

English Abstract for Publication No. 1020010010195.
English Abstract for Publication No. 20-0238202.
English Abstract for Publication No. 2005-347133.
English Abstract for Publication No. 1020080064324.

* cited by examiner

*Primary Examiner* — Kwang-Su Yang
(74) *Attorney, Agent, or Firm* — F. Chau & Associates, LLC

(57) ABSTRACT

A method of driving a light source of a light source module including a red light source, a green light source and a blue light source, includes sensing a luminous intensity of the environment; and adjusting a wavelength of light generated from the light source module according to the luminous intensity of the environment.

15 Claims, 7 Drawing Sheets

METHOD OF DRIVING A LIGHT SOURCE, LIGHT SOURCE APPARATUS FOR PERFORMING THE METHOD AND DISPLAY APPARATUS HAVING THE LIGHT SOURCE APPARATUS

PRIORITY STATEMENT

This application claims priority under 35 U.S.C. §119 to Korean Patent Application No. 2008-115407, filed on Nov. 19, 2008 in the Korean Intellectual Property Office (KIPO), the contents of which are herein incorporated by reference in their entirety.

BACKGROUND OF THE INVENTION

1. Field of the Invention

The present disclosure is directed to a method of driving a light source, a light source apparatus for performing the method, and a display apparatus having the light source apparatus. More particularly, exemplary embodiments of the present invention are directed to a method of driving a light source for improving display quality, a light source apparatus for performing the method, and a display apparatus having the light source apparatus.

2. Description of the Related Art

In general, a liquid crystal display (LCD) apparatus includes an LCD panel displaying an image using optical transmittance of liquid crystal molecules and a backlight assembly disposed below the LCD panel to provide the LCD panel with light.

The LCD panel typically includes an array substrate, a color filter substrate and a liquid crystal layer. The array substrate typically includes a plurality of pixel electrodes and a plurality of thin-film transistors (TFTs) electrically connected to the pixel electrodes. The color filter substrate faces the array substrate and has a common electrode and a plurality of color filters. The liquid crystal layer is interposed between the array substrate and the color filter substrate. When an electric field generated between the pixel electrode and the common electrode is applied to the liquid crystal layer, the arrangement of liquid crystal molecules of the liquid crystal layer is altered to change the optical transmissivity of the liquid crystal layer, so that an image may be displayed on the LCD panel. The LCD panel displays a white image of high luminance when an optical transmittance is increased to maximum, and the LCD panel displays a black image of low luminance when the optical transmittance is decreased to minimum.

The retina of the human eye contains two types of photoreceptor cells, rods and cones. The rods are mainly active when the luminous intensity of the environment is under 1 cd/m$^2$, and the cones are mainly active when the luminous intensity of the environment is over 30 cd/m$^2$.

FIG. 1 is a graph illustrating the relative luminance efficiency of photoreceptor cells of an eye.

Referring to FIG. 1, a first graph V' illustrates a luminance efficiency of a dark environment at a luminous intensity under 1 cd/m$^2$. A second graph V illustrates a luminance efficiency of a bright environment at a luminous intensity over 30 cd/m$^2$. According to the first and second graphs V' and V, the photoreceptor cells of the eye are more sensitive to light at short wavelengths in a dark environment, and are more sensitive to light at long wavelengths in a bright environment. The luminance efficiency of the photoreceptor cells differs according to the luminous intensity of the environment even though a luminance of an image displayed the display apparatus is the same. Therefore, an image color may differently perceived according to the luminance.

SUMMARY OF THE INVENTION

Exemplary embodiments of the present invention provide a method of locally dimming a light source capable of enhancing display quality.

Exemplary embodiments of the present invention provide a light source apparatus for performing the above-mentioned method.

Exemplary embodiments of the present invention provide a display apparatus having the above-mentioned light source apparatus.

According to one aspect of the present invention, a method of driving a light source of a light source module including a red light source, a green light source and a blue light source includes sensing a luminous intensity of the environment and adjusting a wavelength of light generated from the light source module according to the luminous intensity of the environment.

According to another aspect of the present invention, a light source apparatus includes a light source module and a light source module driving part. A light source module includes a red light source, a green light source and a blue light source. A light source module driving part adjusts a wavelength of a light generated from the light source module according to the luminous intensity of the environment.

According to still another aspect of the present invention, a display apparatus includes a display panel, a light source module and a light source module driving part. A display panel displays an image. A light source module includes a red light source, a green light source and a blue light source, providing the display panel with a light. A light source module driving part adjusts a wavelength of a light generated from the light source module according to the luminous intensity of the environment.

According to exemplary embodiments of the present invention, the wavelength of light is adjusted according to the luminous intensity of the environment to compensate for the color perceived by a human eye.

DETAILED DESCRIPTION OF THE INVENTION

Figure 1:
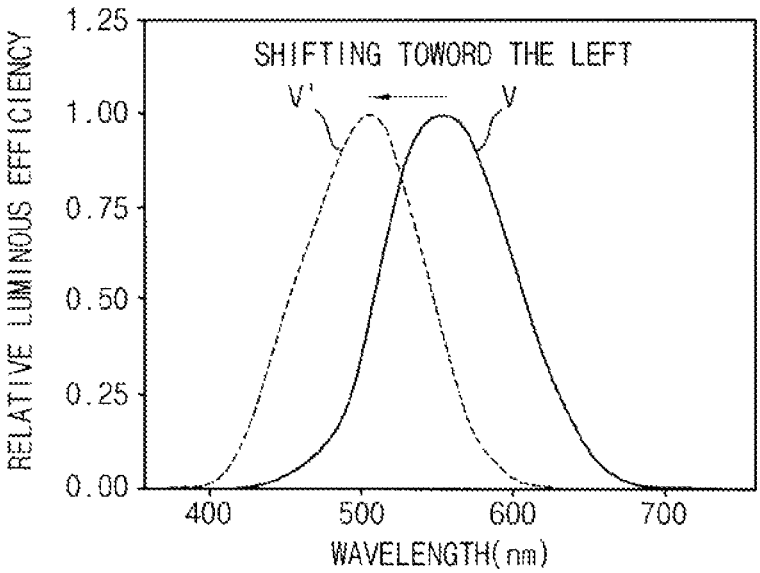
FIG. 1 is a graph illustrating the relative luminance efficiency of a photoreceptor cells of an eye.

The present invention is described more fully hereinafter with reference to the accompanying drawings, in which exemplary embodiments of the present invention are shown. The present invention may, however, be embodied in many different forms and should not be construed as limited to the exemplary embodiments set forth herein. In the drawings, the sizes and relative sizes of layers and regions may be exaggerated for clarity.

It will be understood that when an element or layer is referred to as being "on," "connected to" or "coupled to" another element or layer, it can be directly on, connected or coupled to the other element or layer or intervening elements or layers may be present. Like numerals refer to like elements throughout.

Hereinafter, the present invention will be explained in detail with reference to the accompanying drawings.

Figure 2:
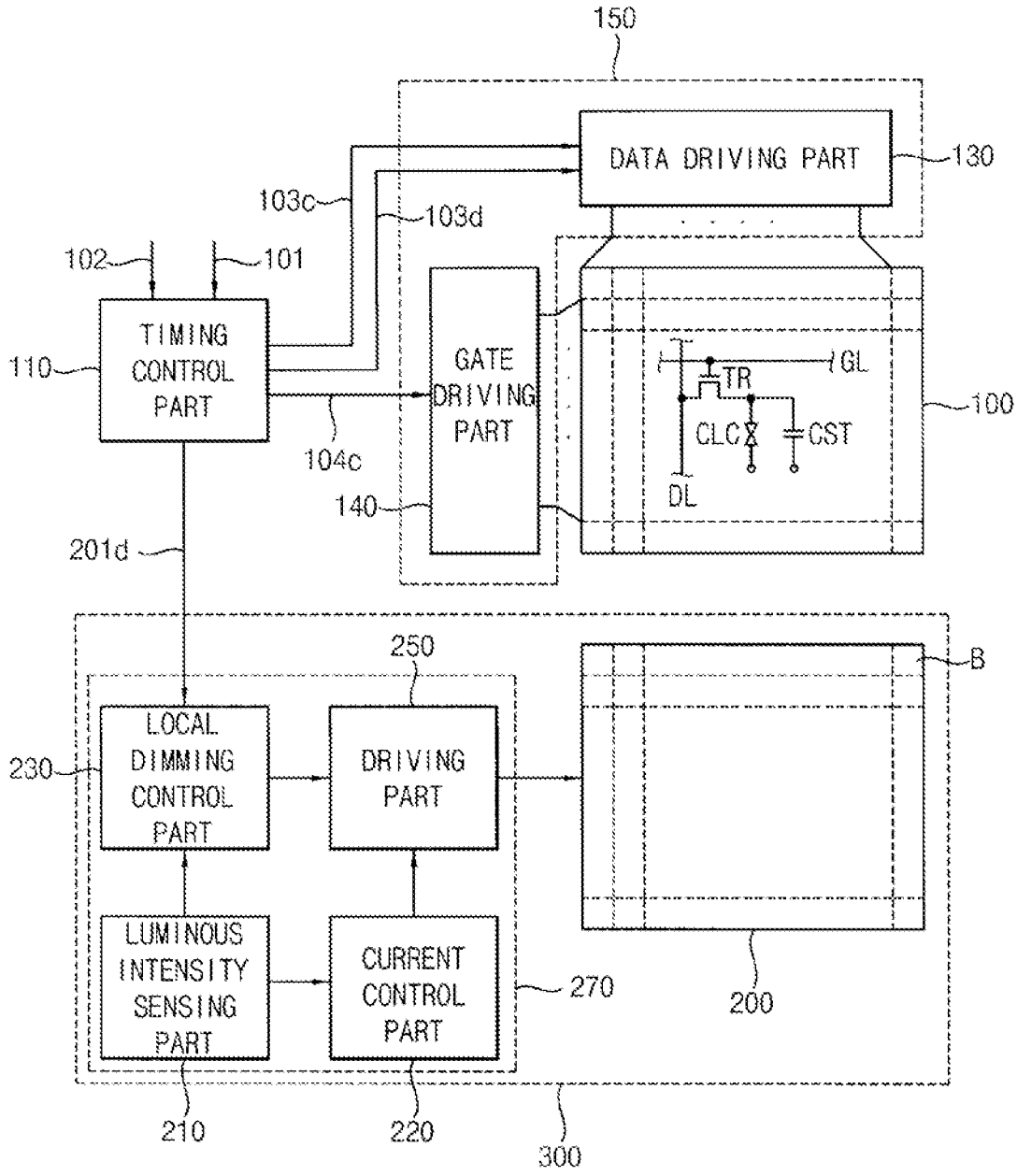
FIG. 2 is a block diagram illustrating a display apparatus according to an embodiment of the present invention.

FIG. 2 is a block diagram illustrating a display apparatus according to an embodiment of the present invention.

Referring to FIG. 2, the display apparatus includes a display panel 100, a timing control part 110, a panel driving part 150 and a light source apparatus 300.

The display panel 100 includes a plurality of pixels displaying an image. For example, the number of the pixels may be M×N (wherein M and N are natural numbers). Each pixel P includes a switching element TR connected to a gate line GL and a data line DL, a liquid crystal capacitor CLC and a storage capacitor CST that are connected to the switching element TR.

The timing control part 110 receives a control signal 101 and an image signal 102 from an external device. The timing control part 110 generates timing control signals which control a driving timing of the display panel 100 by using the received control signal. The timing control signals include a clock signal, a horizontal start signal and a vertical start signal.

The panel driving part 150 includes a data driving part 130 and a gate driving part 140.

The data driving part 130 drives the data line DL by using a data control signal 103*c* and an image signal 103*d* received from the timing control part 110. The data driving part 130 converts the image signal 103*c* into an analog data signal to output to the data line DL. The gate driving part 140 drives the gate line GL by using a gate control signal 104*c* received from the timing control part 110. The gate driving part 140 outputs a gate signal to the gate line GL.

The light source apparatus 300 provides the display panel 100 with light, and adjusts a wavelength of the light according to a luminous intensity of the environment where the display apparatus is located. For example, the light source apparatus 300 generates long wavelength light in dark environments having a low luminous intensity and short wavelength light in bright environments having a high luminous intensity. The light source apparatus 300 generates normal wavelength light in normal environments having a normal luminous intensity. The light source apparatus 300 may adjust the wavelength of the light by adjusting a peak current of a driving signal driving the light source.

For example, the light source apparatus 300 includes a light source module 200 and a light source module driving part 270.

The light source module 200 includes a printed circuit board (PCB) having a plurality of light sources. The light source module 200 includes red, green and blue light sources. The light source module 200 is divided into I×J (wherein I and J are natural numbers) light-emitting blocks B. The light-emitting blocks B may be individually driven corresponding to an image being displayed on the display panel 100. The light-emitting block B includes a red light source, a green light source and a blue light source. The light source may include a light emitting diode (LED).

The light source module driving part 270 includes a luminous intensity sensing part 210, a current control part 220, a local dimming control part 230 and a driving part 250.

The luminous intensity sensing part 210 is disposed in the outside of the display apparatus to sense the luminous intensity of the environment. The luminous intensity sensing part 210 provides the local dimming control part 230 and the driving part 250 with an intensity signal.

The current control part 220 adjusts a current level of the driving signal based on the intensity signal received from the luminous intensity sensing part 210. For example, the current control part 220 increases a peak current of a red driving signal to a first current level in the dark environment having the intensity signal less than a low reference value. The current control part 220 increases a peak current of a green driving signal to a second current level in the bright environment having the intensity signal greater than a high reference value. In addition, the current control part 220 adjusts peak currents of the red and green driving signals to third and fourth current levels, respectively, in the normal environment having the intensity signal existing between the low reference value and the high reference value.

The local dimming control part 230 divides the image signal into a plurality of image blocks D corresponding to the light-emitting blocks B, and controls a luminance of each of the light-emitting blocks B based on a gray-scale of each of the image blocks D. The local dimming control part 230 adjusts reference duty ratios of red, green and blue driving signals based on the intensity signal received from the luminous intensity sensing part 210. The local dimming control part 230 decreases reference duty ratio of the red driving signal to a first duty ratio in the dark environment, and decreases reference duty ratio of the green driving signal to a second duty ratio in the bright environment. The local dimming control part 230 adjusts reference duty ratios of the red and green driving signals to third and fourth duty ratios in the normal environment. The local dimming control part 230 adjusts the reference duty ratio inversely to the current magnitude. Therefore, a luminance of the full white light is maintained to be substantially uniform irrespective of the luminous intensity of the environment.

The driving part 250 generates red, green and blue driving signals under control of the current control part 220 and the local dimming control part 230. The current level and the duty ratio of the red, green and blue driving signals are adjusted according to the luminous intensity of the environment.

Figure 3:
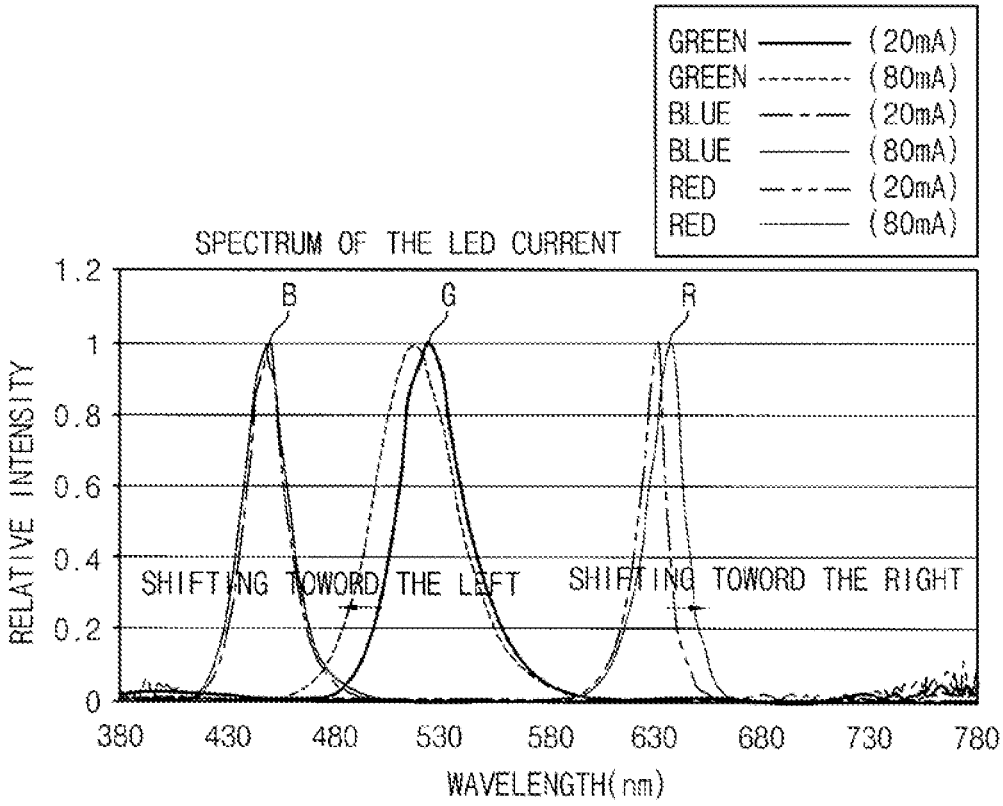
FIG. 3 is a graph illustrating a wavelength spectrum of a driving current driving a light source of the display apparatus of FIG. 2.

FIG. 3 is a graph illustrating a wavelength spectrum of a driving current driving a light source of the display apparatus of FIG. 2.

Referring to FIG. 3, a spectrum B of a blue LED shows essentially no movement when the current magnitude changes from about 20 mA to about 80 mA. A spectrum G of a green LED moves leftward (toward a shorter wavelength) when the current magnitude changes from about 20 mA to about 80 mA. A spectrum R of a red LED moves rightward (toward a longer wavelength) when the current magnitude changes from about 20 mA to about 80 mA.

Referring to FIG. 1, the photoreceptor cells of the eye are more sensitive to short wavelengths in dark environments than in bright environments, and are more sensitive to long wavelengths in bright environments than in dark environments. Therefore, the display panel displays longer wavelength light in darker environments and the display panel displays shorter wavelength light in brighter environments, to improve the sensitivity of the human eye irrespective of the luminous intensity of the environment.

Referring to FIGS. 1 and 3, according to an embodiment of the present invention, the peak current of the red driving signal increases to lengthen the light wavelength to compensate the color coordinate in a dark environment. The peak current of the green driving signal increases to shorten the light wavelength to compensate the color coordinate in a bright environment. The peak currents of the red and green driving signals adjust to compensate the color coordinate in a normal environment.

Figure 4:
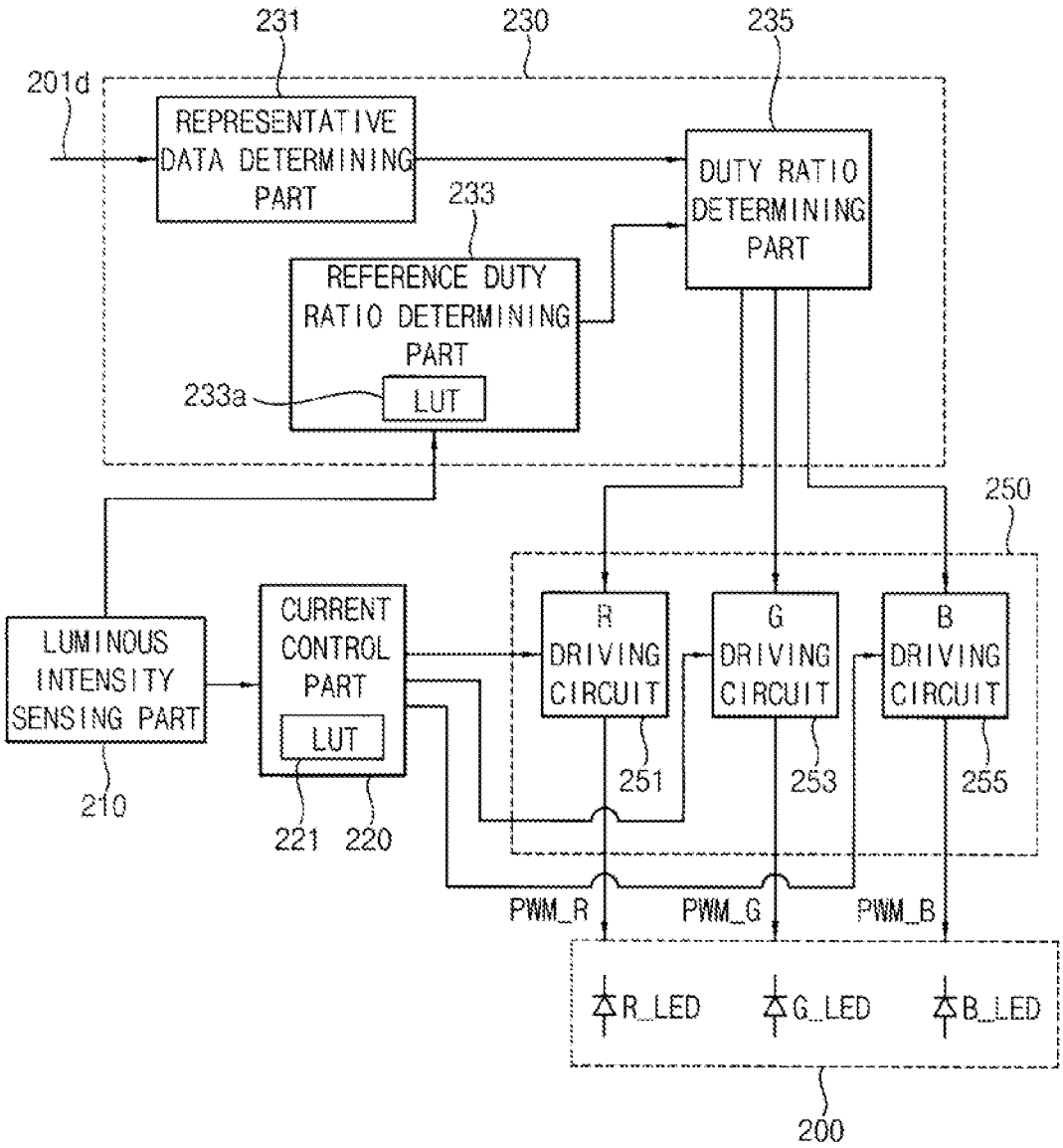
FIG. 4 is a block diagram illustrating the light source apparatus of FIG. 2.

FIG. 4 is a block diagram illustrating the light source apparatus of FIG. 2.

Referring to FIGS. 2 and 4, the light source module driving part 270 includes a luminous intensity sensing part 210, a current control part 220, a local dimming control part 230, and a driving part 250.

The luminous intensity sensing part 210 senses the luminous intensity of the environment, and provides the current control part 220 and the local dimming control part 230 with intensity signals.

The current control part 220 includes a look up table (LUT) 221 that stores the peak current corresponding to the intensity signal. The current control part 220 adjusts the peak current of the driving signal based on the intensity signal by using the LUT 221 to provide the driving part 250 with the intensity signal.

For example, the current control part 220 increases the peak current of the red driving signal driving the red light source to a first current level IR' when the intensity signal is less than a low reference value corresponding to a dark environment. The current control part 220 adjusts the peak currents of the green and blue driving signals driving the green and blue light sources to initial current levels IGi and IBi, respectively.

The current control part 220 increases the peak current of the green driving signal driving the green light source to a second current level IG' when the intensity signal is greater than a high reference value corresponding to a bright environment. The current control part 220 adjusts the peak currents of the red and blue driving signals driving the red and blue light sources to initial current levels IRi and IBi, respectively.

The current control part 220 adjusts the peak currents of the red and green driving signal to third and fourth current levels IR" and IG" corresponding to the intensity signal by using the LUT 221 when the intensity signal is between the low reference value and the high reference value, which corresponds to a normal environment. The current control part 220 adjusts the peak current of the blue driving signal to the initial current level IBi. The third current level IR" is between the initial current level IRi and the first current level IR', and the fourth current level IG" is between the initial current level IGi and the second current level IG'.

The local dimming control part 230 includes a representative data determining part 231, a reference duty ratio determining part 233 and a duty ratio determining part 235. The representative data determining part 231 divides the image signal 201*d* received from the timing control part 110 into a plurality of image blocks D corresponding to the light-emitting blocks B.

The representative data determining part 231 determines red, green and blue representative gray-scales by using red, green and blue gray-scales included in each of the image blocks D. For example, the red representative gray-scale may be an average red gray-scale, a maximum red gray-scale, etc. The red, green and blue representative gray-scales may be determined by various formulas. Therefore, the representative data determining part 231 determines the red, green and blue representative gray-scales of the image block D corresponding to the light-emitting blocks B.

The reference duty ratio determining part 233 includes a look up table (LUT) 223*a* that stores reference duty ratios of the red, green and blue driving signals corresponding to the intensity signal according to the luminous intensity of the environment. The reference duty ratio determining part 233 determines the reference duty ratios of the red, green and blue driving signals by using the LUT 233*a* based on the intensity signal. For example, the reference duty ratios of the red, green and blue driving signals may be duty ratios of the red, green and blue driving signals for generating the fall white light.

For example, the reference duty ratio determining part 233 determines a duty ratio of the red driving signal in a dark environment to be a first duty ratio dR' that is less than an initial duty ratio dRi. Herein, the peak current of the red driving signal has a first current magnitude greater than an initial current magnitude. The reference duty ratio determining part 233 determines duty ratios of the green and blue driving signals to be initial duty ratios dGi and dBi, respectively. Therefore, in a dark environment, the reference duty ratios of the red, green and blue driving signals have a ratio of dR':dGi:dBi.

The reference duty ratio determining part 233 determines a duty ratio of the red driving signal in a bright environment to be a second duty ratio dG' that is less than an initial duty ratio dGi. Herein, the peak current of the green driving signal has a second current magnitude greater than an initial current magnitude. The reference duty ratio determining part 233 determines duty ratios of the red and blue driving signals to be initial duty ratios dRi and dBi, respectively. Therefore, in a bright environment, the reference duty ratios of the red, green and blue driving signals have a ratio of dRi:dG':dBi.

The reference duty ratio determining part 233 determines third and fourth duty ratios dR and dG of the red and green driving signals in a normal environment by using the LUT 233*a* based on the intensity signal. The third and fourth duty ratios dR and dG of the red and green driving signals are determined corresponding to the peak currents of the red and green driving signals having the third and fourth current magnitudes. Therefore, in a normal environment, the reference duty ratios of the red, green and blue driving signals have a ratio of dR:dG:dBi. The third duty ratio dR is between the initial duty ratio dRi and the first duty ratio dR', and the fourth duty ratio dG is between the initial duty ratio dGi and the second duty ratio dG'.

The duty ratio determining part 235 determines duty ratios of the red, green and blue driving signals by using the red, green and blue representative gray-scales of the light-emitting block B based on the reference duty ratios determined according to the luminous intensity of the environment. Thus, the light-emitting blocks B may be controlled by the color dimming mode according to the luminous intensity of the environment.

The driving part 250 includes a red (R) driving circuit 251, a green (G) driving circuit 253 and a blue (B) driving circuit 255. Each of the red, green and blue driving circuits 251, 253 and 255 generates red, green and blue driving signals by using the peak currents that are provided from the current control part 220 and the duty ratios that are provided from the duty ratio determining part 235. The red driving circuit 251 provides the red light sources R_LED of the light-emitting block B with the red driving signal PWM_R. The green driving circuit 253 provides the green light sources G_LED of the light-emitting block B with the green driving signal PWM_G.

The blue driving circuit 255 provides the blue light sources B_LED of the light-emitting block B with the blue driving signal PWM_B.

Finally, the reference duty ratios of the red, green and blue driving signals relative to the full white light were determined corresponding to the peak currents of the red, green and blue driving signals as determined according to the luminous intensity of the environment. Therefore, the duty ratio is adjusted corresponding to the peak current variation so that the luminous intensity of the full white light generated by the red, green and blue light sources is maintained to be substantially uniform irrespective of the luminous intensity of the environment. Thus, the human eye can perceive the same color irrespective of the luminous intensity of the environment.

Figure 5:
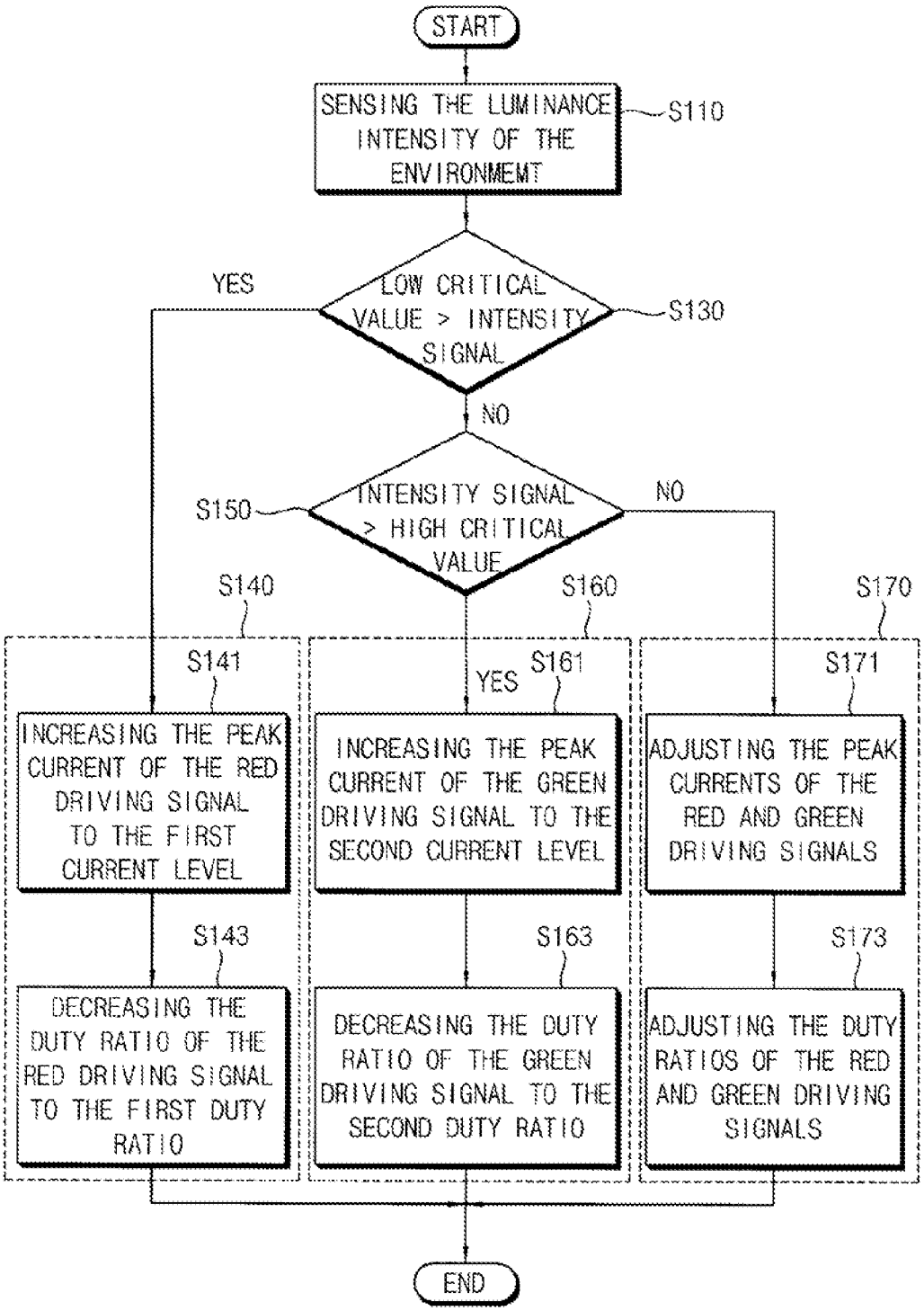
FIG. 5 is a flowchart illustrating a method of driving the light source apparatus of FIG. 4.

FIG. 5 is a flowchart illustrating a method of driving the light source apparatus of FIG. 4.

Referring to FIGS. 3 and 5, the luminous intensity sensing part 210 senses the luminous intensity of the environment to generate the intensity signal (step S110).

The intensity signal is compared with the low reference value (step S130). When the intensity signal is less than the low reference value, the wavelength of the light generated from the light source module 200 is adjusted to increase the wavelength of the light (step S140). For example, the current control part 220 increases the peak current of the red driving signal driving the red light source to the first current level (step S141). The reference duty ratio determining part 233 decreases the first duty ratio of the red driving signal that has the peak current increased to the first current level (step S143). The peak current of the red driving signal is increased to lengthen the wavelength of the light. Thus, the color perceived by the human eye in a dark environment may be compensated. In addition, the duty ratio of the red driving signal is decreased to prevent increasing the luminous intensity of the full white light. The luminous intensity of the full white light generated by the light source module 200 is maintained to be substantially uniform irrespective of the luminous intensity of the environment.

In the step S130, when the intensity signal is greater than the low reference value, the intensity signal is compared with the high reference value (step S150). When the intensity signal is greater than the high reference value, the wavelength of the light generated from the light source module 200 is adjusted to decrease the wavelength of the light (step S160). For example, the current control part 220 increases the peak current of the green driving signal driving the green light source to the second current level (step S161). The reference duty ratio determining part 233 decreases the second duty ratio of the green driving signal that has the peak current increased to the second current level (step S163). The peak current of the green driving signal is increased shorten the wavelength of the light. Thus, the color perceived by a human eye in a bright environment may be compensated. In addition, the duty ratio of the green driving signal is decreased to prevent increasing the luminous intensity of the fall white light. The luminous intensity of the full white light generated by the light source module 200 is maintained to be substantially uniform irrespective of the luminous intensity of the environment.

In the step S150, when the intensity signal is less than the high reference value and is between the low reference value and the high reference value, the wavelength of the light generated from the light source module 200 is adjusted according to the luminous intensity of the environment (step S170). For example, the current control part 220 determines the peak currents of the red and green driving signals to third and fourth current magnitudes corresponding to the intensity signal by using the LUT 221 (step S171). The reference duty ratio determining part 233 determines third and fourth duty ratios of the red and green driving signals by using the LUT 233*a* based on the intensity signal (step S173).

The light wavelength is adjusted according to the luminous intensity of the environment to compensate for the color perceived by the human eye in a bright environment. In addition, the duty ratio corresponding to the peak current variation is adjusted to maintain the substantially uniform luminous intensity of the full white light generated by the light source module 200.

Figure 6:
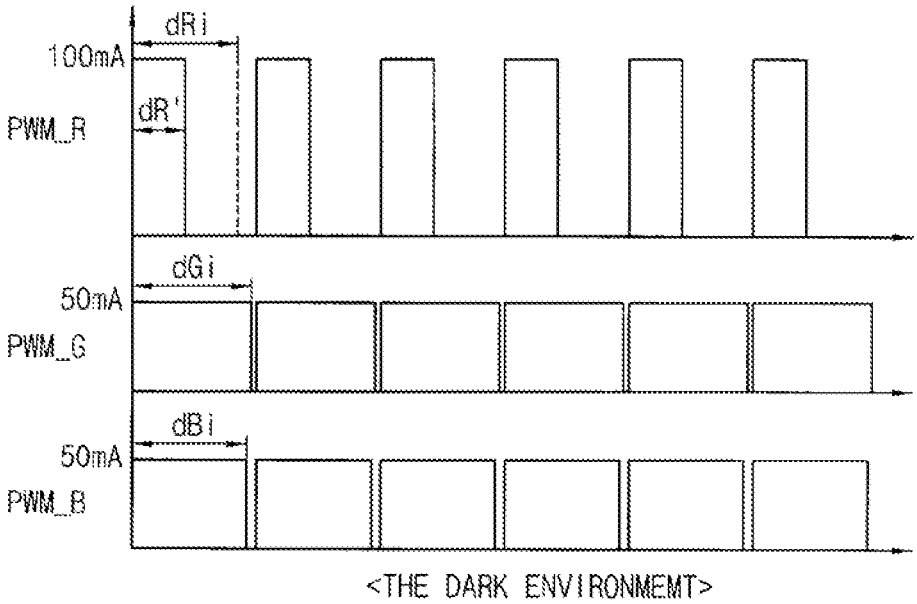
FIG. 6 is a wave form diagram illustrating a driving signal of the display apparatus of FIG. 2 for a dark environment.

FIG. 6 is a wave form diagram illustrating a driving signal of the display apparatus of FIG. 2 for a dark environment.

Referring to FIG. 6, when peak currents of the red, green and blue driving signals were determined to be initial currents, the full white light was generated by the red, green and blue driving signals having the initial duty ratios. For example, the initial duty ratios of the red, green and blue driving signals had a ratio of dRi:dGi:dBi.

In a dark environment, a peak current of the red driving signal was increased from an initial current magnitude of about 50 mA to a first current magnitude of about 100 mA. The peak currents of the green and blue driving signals are the initial current magnitudes of about 50 mA.

In addition, a duty ratio of the red driving signal was decreased from an initial duty ratio of about dRi to a first duty ratio of about dR'. Thus, the duty ratios of the red, green and blue driving signals in a dark environment have a ratio of dR:dGi:dBi.

According to an embodiment of the invention, in a dark environment, the peak current of the red driving signal was increased and the duty ratio of the red driving signal corresponding to the peak current variation was decreased, to compensate for the color perceived by the human eye and to maintain the substantially uniform luminous intensity of the full white light.

Figure 7:
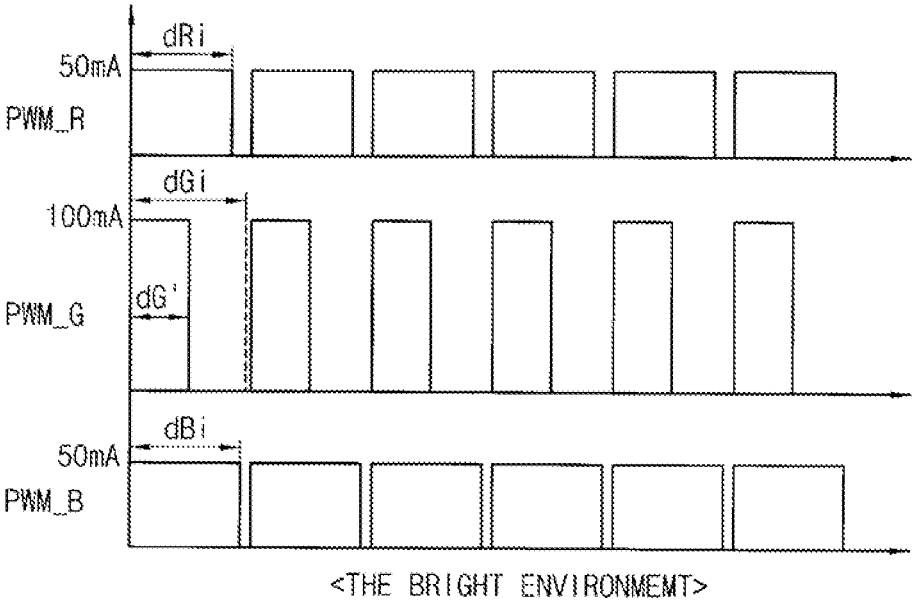
FIG. 7 is a wave form diagram illustrating a driving signal of the display apparatus of FIG. 2 for a bright environment.

FIG. 7 is a wave form diagram illustrating a driving signal of the display apparatus of FIG. 2 for a bright environment.

Referring to FIG. 7, when peak currents of the red, green and blue driving signals were determined to be initial currents, the full white light was generated by the red, green and blue driving signals having the initial duty ratios. For example, the initial duty ratios of the red, green and blue driving signals had a ratio of dRi:dGi:dBi.

In a bright environment, a peak current of the green driving signal was increased from an initial current magnitude of about 50 mA to a second current magnitude of about 100 mA. The peak currents of the red and blue driving signals are those of the initial current magnitudes of about 50 mA.

In addition, a duty ratio of the green driving signal was decreased from an initial duty ratio of about dRi to a second duty ratio of about dG'. Thus, the duty ratios of the red, green and blue driving signals in a bright environment had a ratio of dRi:dG':dBi.

According to an embodiment of the invention, in a bright environment, the peak current of the green driving signal was increased and the duty ratio of the green driving signal corresponding to the peak current variation was decreased, to compensate for the color perceived by the human eye and to maintain the substantially uniform luminous intensity of the full white light.

Figure 8:
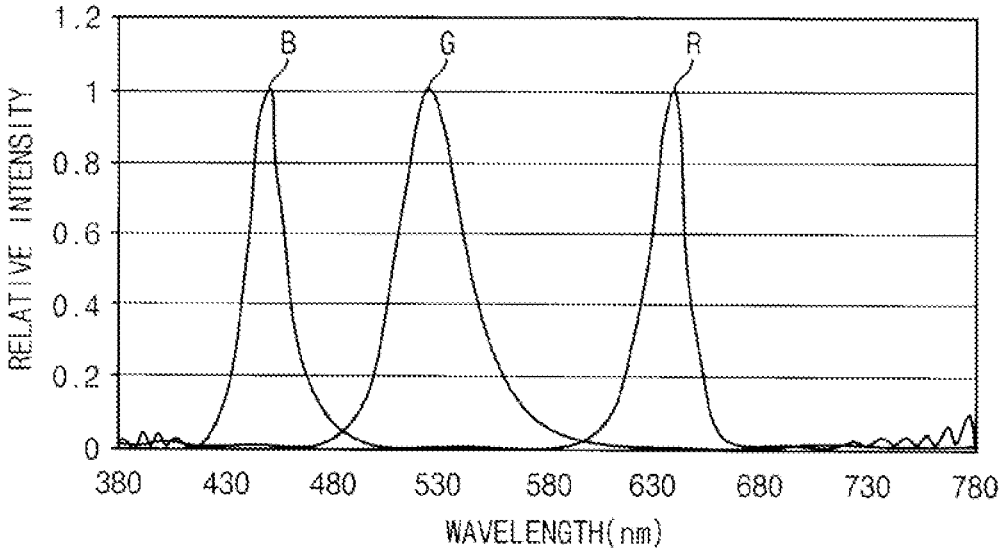
FIG. 8 is a graph illustrating a wavelength spectrum of light of a comparative example.
Figure 9:
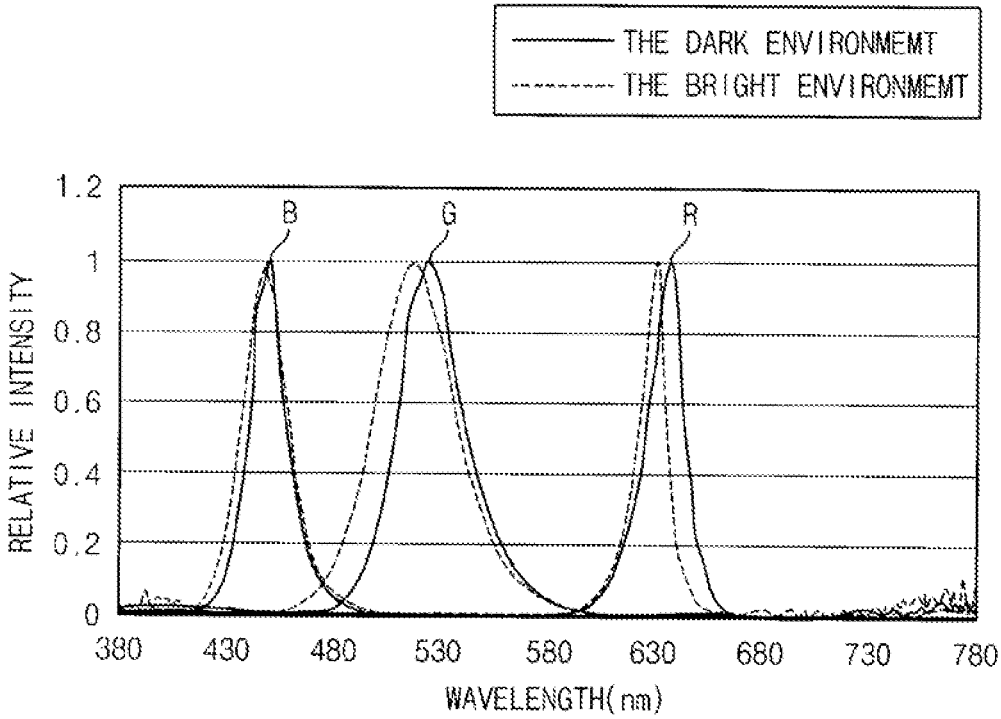
FIG. 9 is a graph illustrating a wavelength spectrum of a light of the display apparatus of FIG. 2.

FIG. 8 is a graph illustrating a wavelength spectrum of light of a comparative example. FIG. 9 is a graph illustrating a wavelength spectrum of light of the display apparatus of FIG. 2

Referring to FIGS. 1 and 8, in the comparison example, the red, green and blue LEDs were driven using the red, green and blue driving signals having a same peak current.

Referring to the spectrum of the comparison example as the shown FIG. 8 and the luminance efficiency of the eye as the shown FIG. 1, the human eye perceives an image displayed by the light of the comparison example to be a bluish image because the human eye has a greater sensitivity to shorter wavelengths in a dark environment. Also, the human eye perceives an image displayed by the light of the comparison example to be a reddish image because the human eye has a greater sensitivity to longer wavelengths in a bright environment.

Referring to FIGS. 1 and 9, in an embodiment of the invention, the red, green and blue LEDs were driven using the red, green and blue driving signals where the peak current was adjusted according to the luminous intensity of the environment. The wavelength R of the red light was shifted toward a longer wavelength in a dark environment and the wavelength G of the green light was shifted toward a shorter wavelength in a bright environment.

Referring to the spectrum according to an embodiment as shown in FIG. 9 and the luminance efficiency of the eye as shown in FIG. 1, a reddish image was displayed by the light of the embodiment of FIG. 9 in a dark environment. However, the human eye could perceive an image of the original color because the human eye has a greater sensitivity to shorter wavelengths in dark environments. Also, an bluish image was displayed by the light of the embodiment of FIG. 9 in a bright environment. However, the human eye could perceive an image of the original color because the human eye has a greater sensitivity to longer wavelengths in bright environments.

According to an embodiment of the present invention, the wavelength of light is adjusted according to the luminous intensity of the environment to compensate for the color perceived by a human eye. Therefore, the display quality of the image that is displayed on the display apparatus may be enhanced.

The foregoing is illustrative of the present invention and is not to be construed as limiting thereof. Although a few exemplary embodiments of the present invention have been described, those skilled in the art will readily appreciate that many modifications are possible in the exemplary embodiments without materially departing from the novel teachings and advantages of the present invention. Accordingly, all such modifications are intended to be included within the scope of the present invention as defined in the claims. Therefore, it is to be understood that the foregoing is illustrative of the present invention and is not to be construed as limited to the specific exemplary embodiments disclosed, and that modifications to the disclosed exemplary embodiments, as well as other exemplary embodiments, are intended to be included within the scope of the appended claims. The present invention is defined by the following claims, with equivalents of the claims to be included therein.

What is claimed is:

1. A method of driving a light source of a light source module that includes a plurality of light-emitting blocks, each light-emitting block including a red light source, a green light source and a blue light source, the method comprising:

sensing a luminous intensity of an environment;

adjusting a wavelength of light generated from the light source module according to the luminous intensity of the environment; and individually controlling a luminance of the light-emitting blocks according to a gray-scale of a plurality of image blocks corresponding to the light-emitting blocks using the light adjusted by the wavelength, wherein adjusting the wavelength of the light includes:

increasing the wavelength of the light when the luminous intensity is less than a low reference value; and decreasing the wavelength of the light when the luminous intensity is greater than a high reference value, wherein increasing the wavelength of the light includes:

increasing a peak current of a red driving signal driving the red light source; and decreasing a duty ratio of the red driving signal.

2. The method of claim 1, wherein decreasing the wavelength of the light includes:

increasing a peak current of a green driving signal driving the green light source; and decreasing a duty ratio of the green driving signal.

3. The method of claim 1, wherein adjusting the wavelength of the light includes:

adjusting the wavelength of the light when the luminous intensity is between the low reference value and the high reference value.

4. The method of claim 3, wherein adjusting the wavelength of the light includes:

adjusting peak currents of red and green driving signals driving the red and green light sources; and adjusting duty ratios of the red and green driving signals.

5. A light source apparatus comprising:

a light source module that includes a plurality of light-emitting blocks, each light-emitting block including a red light source, a green light source and a blue light source;

a light source module driving part adapted to adjust a wavelength of light generated from the light source module according to a luminous intensity of an environment by individually controlling a luminance of the light-emitting blocks according to a gray-scale of a plurality of image blocks corresponding to the light-emitting blocks using the light adjusted by the wavelength, wherein the light source module driving part includes:

a luminous intensity sensing part sensing the luminous intensity of the environment to generate an intensity signal;

a current control part adjusting a peak current of a driving signal driving the plurality of light-emitting blocks based on the intensity signal; and a local dimming control part adjusting a duty ratio of the driving signal based on the intensity signal, and wherein the local dimming control part includes: a reference duty ratio determining part that determines reference duty ratios of the red, green and blue driving signals by using the intensity signal, and wherein the current control part increases the peak current of the red driving signal driving the red light source and the reference duty ratio determining part decreases the duty ratio of the red driving signal, when the intensity signal is less than a low reference value.

6. The light source apparatus of claim 5, wherein the light source module driving part increases the wavelength of the light when the luminous intensity is less than the low reference value, and decreases the wavelength of the light when the luminous intensity is greater than a high reference value.

7. The light source apparatus of claim 5, wherein the light source module driving part adjusts the wavelength of the light when the luminous intensity is between the low reference value and a high reference value.

8. The light source apparatus of claim 5, wherein the light source module driving part includes:

a driving part generating the driving signal by using the adjusted peak current and the adjusted duty ratio.

9. The light source apparatus of claim 8, wherein the local dimming control part includes:

a representative data determining part that divides an image signal into the plurality of image blocks corresponding to the light-emitting blocks and determines red, green and blue representative gray-scales by using red, green and blue gray-scales included each of the image blocks, and a duty ratio determining part that determines duty ratios of the red, green and blue driving signals by using the red, green and blue representative gray-scales based on the reference duty ratios.

10. The light source apparatus of claim 9, wherein the current control part increases the peak current of the green driving signal driving the green light source and the reference duty ratio determining part decreases the duty ratio of the green driving signal, when the intensity signal is greater than a high reference value.

11. The light source apparatus of claim 10, wherein the current control part changes the peak currents of the red and green driving signals driving the red and green light sources and the reference duty ratio determining part changes the duty ratios of the red and green driving signals, when the intensity signal is between the low reference value and the high reference value.

12. The light source apparatus of claim 11, wherein the current control part includes a look up table that stores the peak currents of the red, green and blue driving signals corresponding to the intensity signal.

13. A display apparatus comprising:

a display panel displaying an image;

a light source module that includes a plurality of light-emitting blocks, each light-emitting block including a red light source, a green light source and a blue light source, and providing the display panel with light; and a light source module driving part adapted to adjust a wavelength of the light generated from the light source module according to a luminous intensity of an environment by individually controlling a luminance of the light-emitting blocks according to a gray-scale of a plurality of image blocks corresponding to the light-emitting blocks using the light adjusted by the wavelength, wherein the light source module driving part increases a peak current of a red driving signal driving the red light source when the intensity signal is less than a low reference value, to increase the wavelength of the light.

14. The display apparatus of claim 13, wherein the light source module driving part increases a peak current of a green driving signal driving the green light source when the intensity signal is greater than a high reference value, to decrease the wavelength of the light.

15. The display apparatus of claim 14, wherein the light source module driving part changes the peak currents of the red and green driving signals driving the red and green light sources when the intensity signal is between the low reference value and the high reference value, to adjust the wavelength of the light.

* * * * *